US008541640B2

(12) United States Patent
Bolanos Barrera et al.

(10) Patent No.: US 8,541,640 B2
(45) Date of Patent: Sep. 24, 2013

(54) PROCESS FOR THE DESTRUCTION OF TOXIC RESIDUES VIA OXIDATION IN PRESENCE OF WATER AND OXYGEN AND CONTINUOUS MOBILE UNIT TO TREAT HAZARDOUS COMPOUNDS

(75) Inventors: Gustavo Eduardo Bolanos Barrera, Santiago de Cali (CO); Victor Fernando Marulanda Cardona, Santiago de Cali (CO)

(73) Assignee: Universidad del Valle, Santiago de Cali (CO)

( * ) Notice: Subject to any disclaimer, the term of this patent is extended or adjusted under 35 U.S.C. 154(b) by 0 days.

(21) Appl. No.: 13/133,195

(22) PCT Filed: Dec. 17, 2009

(86) PCT No.: PCT/IB2009/055831
§ 371 (c)(1),
(2), (4) Date: Jun. 7, 2011

(87) PCT Pub. No.: WO2010/070612
PCT Pub. Date: Jun. 24, 2010

(65) Prior Publication Data

US 2011/0237857 A1 Sep. 29, 2011

(30) Foreign Application Priority Data

Dec. 19, 2008 (CO) ..... 08 135446
Dec. 17, 2009 (WO) ..... PCT/IB2009/055831

(51) Int. Cl.
*A62D 3/30* (2007.01)
*A62D 3/33* (2007.01)
*A62D 3/38* (2007.01)

(52) U.S. Cl.
USPC ..... 588/313; 588/1; 588/315; 588/320; 588/400; 588/409

(58) Field of Classification Search
None
See application file for complete search history.

(56) References Cited

U.S. PATENT DOCUMENTS 4,543,190 A * 9/1985 Modell ..... 210/721
5,158,689 A * 10/1992 Ishii et al. ..... 210/762
5,198,122 A * 3/1993 Koszalka et al. ..... 210/748.04
5,466,344 A * 11/1995 Lindke ..... 202/205
5,674,382 A * 10/1997 Chapman ..... 210/96.1

(Continued)

FOREIGN PATENT DOCUMENTS

EP 0755361 10/1995
EP 0898985 5/2003
JP 20000005594 1/2000

OTHER PUBLICATIONS

K. Ballschmiter and M. Zell, Analysis of polychlorinated biphenyls (PCB) by glass capillary gas chromatography, Fresenius Z. Anal. Chem. 302 (1980), pp. 20-31.

*Primary Examiner* — Melvin C Mayes
*Assistant Examiner* — Sheng H Davis
(74) *Attorney, Agent, or Firm* — Maryellen Feehery Hank; Reed Smith LLP

(57) ABSTRACT

Process for the destruction of toxic residues via oxidation in the presence of water and oxygen developed in homogenous phase at temperatures over 374° C. and pressure of at least 220 atmospheres and a continuous mobile unit easily transferred to treat effluents or contaminated media. This mobile unit is composed of a reactor, which includes pressurization, reaction, cooling, depressurization and sampling zones for the destruction of toxic residues like polychloride biphenyls (PCBs), pyridines, and other hazardous compounds.

7 Claims, 1 Drawing Sheet

Schematic diagram of the process

(56) References Cited

U.S. PATENT DOCUMENTS

| | | | | |
|---|---|---|---|---|
| 6,162,958 | A | 12/2000 | Tateishi | |
| 6,168,771 | B1 * | 1/2001 | Saho et al. | 423/245.2 |
| 7,329,395 | B2 | 2/2008 | Akai | |
| 7,682,514 | B2 * | 3/2010 | Scott et al. | 210/759 |
| 2003/0039729 | A1 * | 2/2003 | Murphy et al. | 426/320 |
| 2005/0006317 | A1 * | 1/2005 | Lee et al. | 210/761 |
| 2006/0107976 | A1 * | 5/2006 | Boyers et al. | 134/94.1 |
| 2006/0187751 | A1 * | 8/2006 | Lepine et al. | 366/336 |
| 2007/0240740 | A1 * | 10/2007 | McDermott | 134/26 |
| 2010/0185039 | A1 * | 7/2010 | Hoag et al. | 588/320 |

* cited by examiner

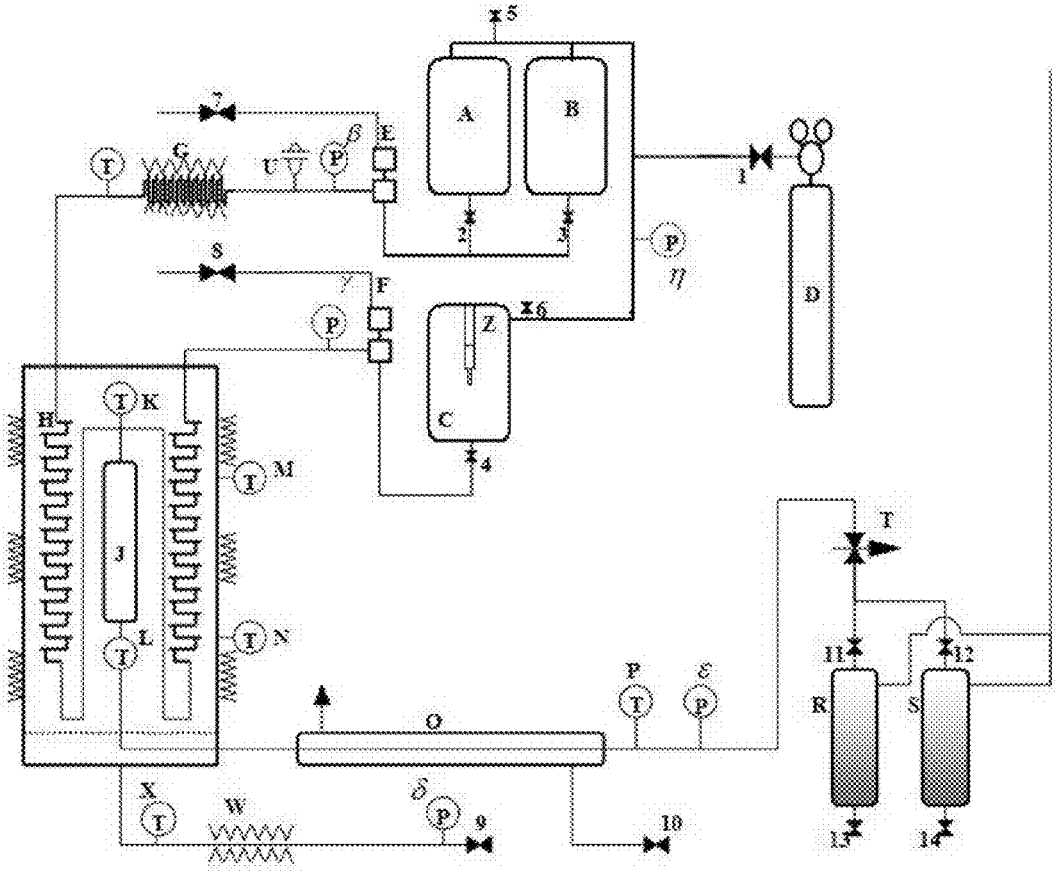
Schematic diagram of the process

PROCESS FOR THE DESTRUCTION OF TOXIC RESIDUES VIA OXIDATION IN PRESENCE OF WATER AND OXYGEN AND CONTINUOUS MOBILE UNIT TO TREAT HAZARDOUS COMPOUNDS

RELATED APPLICATIONS

This application is the United States National Stage of International Application No. PCT/IB2009/1055831, filed Dec. 17, 2009, which was published as International Publication No. WO 2010/070612, and which claims benefit of Columbian Patent Application No. 08 135446 filed Dec. 19, 2008. Both applications are incorporated by reference in their entirety herewith.

FIELD OF THE INVENTION

The invention is related to a process for the destruction of toxic residues that contain polychloride biphenyls (PCBs), pyridines, and other hazardous compounds, via an oxidation process in homogenous phase in the presence of water and oxygen and a continuous mobile unit easily transferred to provision locations of effluents or contaminated media.

BACKGROUND OF THE INVENTION

Toxic residues or wastes are those that because of their corrosive, reactive, explosive, toxic, flammable, infectious, radioactive characteristics may cause risk or damage to human health or to the environment. Furthermore, containers, packaging, and crates that have come into contact with toxic residues or wastes are also considered hazardous residues or wastes. Within the current environmental norms, hazardous residues are all metallic wastes or wastes containing metals like antimony, arsenic, beryllium, cadmium, lead, mercury, selenium, tellurium, thallium; wastes containing mainly inorganic constituents that may contain metals or organic matter like activated glass and catalysts, among others, and wastes containing mainly organic constituents that may contain metals and inorganic matter like thermal liquid wastes, nitrocellulose, phenolic compounds, ethers, wastes from leather tanning processes, halogenated organic solvents, wastes from the production of aliphatic halogenated hydrocarbons, tarry residues, and substances or articles contaminated with polychlorinated biphenyl (PCB), polychlorinated terphenyl (PCT), polychlorinated naphthalene (PCN), or polybrominated biphenyl (PBB) in concentrations greater than or equal to 50 mg/Kg.

Traditionally, the treatment with solvents with the purpose of destroying a wide variety of hazardous organic compounds like polychlorated biphenyls (PCBs) and pyridine has been carried out by means of incineration. However, it is common knowledge that the incineration of these compounds generates incomplete combustion byproducts that end up being more harmful than the chemicals from which they come, for which the use of this treatment process has raised growing rejection in diverse sectors of society. Additionally, incineration is a costly treatment, thus, not easily available in developing nations. This is why there is a tendency to export hazardous residues to other nations to comply with international environmental treaties.

There are numerous treatments developed to eliminate chemical residues with high organic load coming from industry, within which are the treatments under super critical conditions that have shown remarkable results. The nearest anticipations to the invention correspond to some documents disseminated on the state of the art like patent EP 0898985, which divulges a method to treat organic waste materials that comprises a first step of organic material decomposition in the shape of products of low molecular weight subjected to super critical conditions to then apply an oxidation step and decomposition of the products of low molecular weight into carbon dioxide and water, keeping the mixture of the oxidant and the products of low molecular weight in the middle in a subcritical state.

Patent EP0755361 reveals a method for treating waste waters that contain organic matter under super critical conditions (219 atmospheres and temperature between 288 and 649° C.) in the presence of hydrogen peroxide. Additionally, it includes a system which develops a process including an elongated chamber reactor that comprises a frontal portion, a rear portion, a primary reaction zone, and a secondary reaction zone between the frontal portion and rear portion. The system includes media to determine the total oxygen demand in the primary flow current or in the secondary current and control devices for the quantity of oxidizing agent injected to the reactor, as well as devices capable of measuring the total organic carbon of the reactor's output current.

U.S. Pat. No. 7,329,395 shows an apparatus to treat organic residues, comprising a tank to receive organic residues, a hydrogen peroxide storage tank, a pressure regulator, a liquid gas condenser, a collection tank, and a controller for negative pressures. The apparatus for residue treatment includes a line that permits introducing oxidizing agents like oxygen and ozone into the residue treatment zone. The treatment conducted on the liquid comprises the prior addition of sodium hydroxide followed by the addition of formic acid or ammonium to then separate the gases generated in the reaction and add an alkaline solution. Thereafter, ozone or hydrogen peroxide is added or the mixture is placed in contact with UV rays to separate gaseous decomposition products from liquid decomposition products, as well as the radionuclides through a method of ionic exchange, precipitation, or extraction. Once the whole treatment is carried out, a stable solid residue is formed and another liquid phase that can be emitted as a clean residue into sea water.

Recently, it has been suggested that hazardous organic compounds like polychlorated biphenyls (PCBs) and pyridine can be destroyed by means of oxidation in water super critical to innocuous products that can be freed directly onto the environment without additional treatment. Patent JP 2000005594 divulges a method for continuous decomposition of PCB in a reaction medium comprising sodium ethoxide, methanol, carbonate, and sodium hydroxide as catalyst. The reaction conditions correspond to a median temperature level between 100 and 250° C. to react upon nearly 98% of the chlorated compounds; particularly, temperatures between 278 and 350° C. and pressure at 100 to 120 atm are preferred.

Likewise, U.S. Pat. No. 6,162,958 reveals an oxidative decomposition process to decompose PCB, comprising the steps to make the organic matter react with an oxidizing agent like sodium hydroxide in the presence of $CO_2$ and water. The optimal temperature of the reaction is 350° C. and the reaction pH is kept at pH 7.5 by adding NaOH. The products obtained present great corrosive capacity for which a second treatment is conducted with oxygen, air, or hydrogen peroxide.

The process for the destruction of polychlorated biphenyls (PCBs) and other hazardous compounds submitted by the invention is developed under much lower temperature conditions than the incineration processes and may be carried out in a continuous mobile unit that can be transferred directly to the site where the existence of hazardous compounds is identified, eliminating the need for specialized transport and the risks associated with such.

The continuous mobile unit of the invention permits conducting the destruction of effluents or media contaminated with hazardous residue from chemical, cosmetic, and pharmaceutical industry through a process of complete oxidation in homogenous phase in the presence of water and oxygen in supercritical water, especially when the concentration of the organic substances in said aqueous effluent is very low, while it is not possible to destroy such compounds through an incineration process and often it is necessary to use techniques requiring prolonged treatment periods and high costs. For this motive, the technology developed for the treatment of hazardous residues and wastes results viable for developing nations because it solves the technical problem associated with the lack of incineration facilities complying with strict safety requirements for the elimination of hazardous organic contaminants, including polychlorated biphenyls (PCBs) and pyridine.

Also, the novel and inventive vindicated process is different from those revealed by the state of the art through the physical and chemical conditions of the medium as in the characteristics of the reactivos, such is the case of the use of water under super critical conditions to generate the elimination of wastes with diverse chemical and functional characteristics, as the case of organic residues and their mixtures (PCBs and pyridine), which according to the state of the art cause technical problems for their elimination. Furthermore, the process is carried out in a sole oxidation stage under adiabatic conditions, i.e., it does not require water cooling or a second oxidation stage, given that the whole process is developed during a relatively short term to manage destruction of organic matter represented as 99.999% total organic carbon.

Likewise, by means of an emulsifying stage a homogenous reaction phase is assured in which the contaminating products undergo complete oxidation; hence, there is certainty that $CO_2$ and gases are generated with the consequential increase in process efficiency.

Through the combined control of the pressure required, that is, until reaching a maximum of 240 atm for at least 30 seconds, as well as the incorporation of emulsifying agents onto the process and the temperature control within a range between 350 and 530° C., the complete transformation is assured of the halogenated and heteroaromatic hydrocarbons and other additional substances considered hazardous wastes, in order to avoid contamination of water sources and the environmental surroundings where the treatment is conducted.

Furthermore, the novel and inventive process generates the chemical transformation of the contaminating agents without it being necessary to reduce them to substances of low molecular weight to carry out the oxidation, i.e., reduce the stages necessary to cause the oxidation of the contaminating mixtures, as well as time needed to cause their destruction. Eventually, the use of heterogeneous catalysts may be considered like common metallic oxides or supported metals, for example, $Fe_3O_4$, $MnO_2$, CuO, NiO, $Al_2O_3$, $Cu_3O_4$, and Pt that increase process efficiency.

Thus, novel and inventive process divulged does not require adding sodium hydroxide, formic acid, or ammonium to generate the conversion of ions or to separate the gases generated in the reaction; it also does not require adding an alkaline solution or a medium to gather ions produced and generated in the gas.

BRIEF DESCRIPTION OF THE DRAWINGS

FIG. 1 presents a schematic diagram of the process for the destruction of toxic residues developed in the continuous mobile unit of the invention.

OBJECTS OF THE INVENTION

In an initial aspect, the invention provides a process for the destruction of toxic substances and other hazardous organic contaminants that present nuclei of polychlorinated biphenyls (PCBs) and pyridine for thorough oxidation in homogenous phase in the presence of water and oxygen in super critical water.

In a second aspect, the invention provides a continuous mobile unit comprising a reactor that is easily transportable to provision sites of the contaminated effluents or media.

DETAILED DESCRIPTION OF THE INVENTION

To facilitate the description of objects and components of this invention, the following definitions are established for the terms used in the descriptive memory of the present invention.

The expression "polychlorinated biphenyl (PCB)" refers to synthetic aromatic compounds conformed by a nucleus of two benzene rings in which the hydrogen atoms have been partially or totally substituted by chlorine atoms. Its chemical formula is $C_{12}H_{10-n}Cl_n$ where n can vary between 1 and 10. Within these, there are theoretically a total of 209 possible congeners of which 130 have been identified in commercial products. Also, they have been classified according to the chloride content like: mono, di, tri, tetra, penta, hexa, hepta, octa, nona, and decachlorobiphenyls, agreeing with the IUPAC system [Ballschmiter and Zell, 1980 K. Ballschmiter and M. Zell, Analysis of polychlorinated biphenyls (PCB) by glass capillary gas chromatography, Fresenius Z. Anal. Chem. 302 (1980), pp. 20-31].

The expression "wastes or toxic residues" refers to wastes containing organic or inorganic constituents soluble or insoluble in water stemming from the production, preparation, and utilization of pharmaceutical products; wastes resulting from medical, nursing, dental, veterinary practices or similar activities, and wastes generated in hospitals or other facilities during research activities or in the treatment of patients; wastes resulting from the production, preparation, and utilization of biocides and phytopharmaceutical products; wastes resulting from the fabrication, preparation, and utilization of chemical products for Wood preservation; wastes from mixtures and emulsions of oil and water or of hydrocarbons and water; wastes resulting from the fabrication, preparation, and utilization of tinctures, colorants, pigments, paints, lacquer, or varnish; wastes from acid or base solutions; wastes resulting from the utilization of devices for industrial contamination control for depuration of industrial gases, especially considered in the invention are the wastes containing organic constituents but that can contain metals and/or inorganic matter. As non-limiting examples, there are wastes from thermal liquids, nitrocellulose, phenolic compounds, ethers, pyridine and their derivatives; wastes from leather tanning, halogenated organic solvents; wastes from the production of aliphatic halogenated hydrocarbons, tarry residues, bituminous residues, polychlorated biphenyls (PCBs), polychlorated terphenyls (PCTs), polychlorate naphthalenes (PCNs), and polybromated biphenyls (PBBs).

The expression "contaminated medium" refers to a solid medium, aqueous liquid media, oily liquid media, containers, packaging, crates, devices, or equipment contaminated with one or more toxic wastes or residues.

The expression "treatment for the purpose of destruction" refers to the set of unitary operations through which the characteristics of the hazardous wastes or residues are modified to minimize risks to human health and the environment.

According to the first aspect of the invention, toxic residues or wastes among which are especially found polychlorated biphenyls (PCBs) and pyridine present in a contaminated medium with other chemical substances susceptible to treatment via the same process are subjected to an oxidation reaction in homogenous phase as an initial stage of the transformation process for the total destruction of toxic residues, the treatment process comprises the following stages:

a) Availability of an effluent contaminated with a toxic waste or residue;
b) Availability of an oxidizing agent, preferably aqueous hydrogen peroxide, potassium permanganate, potassium dichromate, manganese dioxide, dissolved air, or dissolved gaseous oxygen;
c) Bring the contaminated effluent from stage a) and the oxidizing agent b) to a pressure of at least 240 atmospheres;
d) Preheat the contaminated effluent from stage a) and the oxidizing agent b) to a temperature of at least 350° C. during a first stage, and during a second stage heat to at least 530° C.
e) Make the contaminated effluent from stage a) and the oxidizing agent from stage b) react in a reaction unit at a temperature of at least 530° C. and a pressure of 240 atmospheres for at least 30 seconds.
f) Subject the effluent from stage e) to cooling at a temperature of at least 25° C.
g) Separate and store the phases obtained in stage f) in a gaseous flow and a liquid flow The toxic wastes or residues present in a contaminated medium are oxidized in a reactor upon the formation of the mixture that reacts with water and oxygen. The oxygen is administered as aqueous hydrogen peroxide, potassium permanganate, potassium dichromate, manganese dioxide, dissolved air or dissolved gaseous oxygen, preferably under super critical conditions of the water (at least 374° C. and 220 atmospheres) in a quantity preferably equal or greater than the Stoichiometric amount required to generate the complete oxidation of the organic compound.

The mixture forms a homogenous phase at high temperature, 374° C. or above and pressure of at least 220 atmospheres, where the organic components in a concentration of 0.5 to 25% in weight are placed in close contact with oxygen to be rapidly oxidized. Under super critical conditions of the process, the oxygen and nitrogen are completely miscible with the water in all proportions, eliminating the two-phase flow, for which the mechanical mixing stage is not required. However, when the contaminated medium is an oily liquid, for example dielectric oil, it is necessary to add a non-anionic emulsifying agent with HLB between 10 and 20 for the formation of the homogenous phase where the oxidation is developed; hence, as a requirement of the process it is established that upon carrying out the mixture constituted by the toxic residues, the oxidizing agent and the water, the latter must be present in a proportion of at least 40%. Also, when the contaminated medium is an oily liquid and the emulsifying agent is added, it is necessary to stir the mixture in manual, mechanical, magnetic manner or by means of an ultrasound probe at intensities of at least 10 Khz for at least 1 minute to guarantee the formation of homogenous emulsion.

Because of the existence of a sole homogenous phase in the reaction system constituted by the toxic residue, the oxidizing agent and the water, it is possible to consider the use of heterogeneous catalysts like common metallic oxides or supported metals, for example $Fe_3O_4$, $MnO_2$, CuO, NiO, $Al_2O_3$, $Cu_3O_4$, and Pt. And since the oxidation process is so rapid it is possible to indicate that a chemical transformation is generated in the reactor under conditions of adiabatic operation.

According to the second aspect of the invention, the substantially complete oxidation of the toxic residue that is not exclusively limited to PCBs or pyridine-type residues is carried out in less than 5 minutes in a portable continuous unit comprising:

a) A reservoir (C) to hold organically contaminated material,
b) A means of agitation (Z); which can be an ultrasound probe or other means to create an emulsion,
c) A plurality of reservoirs (A) and (B) to hold one or several oxidizing agents,
d) Means to raise pressure from atmospheric level to supercritical conditions provided with a high-pressure nitrogen source (D) and through high-pressure pumps (E) and (F),
e) Means to elevate temperature from normal conditions to supercritical conditions conformed by pre-heaters (G), (H), and ($H_1$) submerged in isothermal bath surrounded by a host of electrical resistances.
f) A reaction medium to place organically contaminated material in contact with an oxidizing agent, especially considered are tubular-type reactors (J), which can be totally or partially packed with a catalyst bed.
g) Means for heat exchange of the concentric tube exchange type (O).
h) Means for pressure and flow volume regulation of the needle-valve type (T), and
i) Means to separate gaseous and liquid flows (R) and
j) Means of storage that permits taking and collecting samples (S) to conduct analyses of organic contaminants.

The following examples are presented to describe the preferred aspects of the invention, but do not constitute a limitation to the scope of the invention.

EXAMPLE 1

Dielectric oil contaminated with polychlorated biphenyls (PCBs) in a concentration of 7500 milligrams per liter emulsifies in distilled and deionized water by means of the commercial emulsifier Arkopal® (Nonylphenol polyglycol ether) and a process of ultrasound agitation at 25 kilohertz for 10 minutes. The resulting emulsion has organic content of 3% in weight and a concentration of PCBs of 100 milligrams per liter. The viscosity of the emulsion is similar to that of water. This emulsion is loaded onto the tank (C), while the peroxide solution at 8% in weight prepared from industrial peroxide at 50% in weight is loaded onto tanks (A) and (B).

The tanks are pressurized with nitrogen at 50 psi, available from the reservoir (D). Emulsion and oxidant are pressurized by means of high-pressure pumps (E) and (F) at 240 atmospheres. The oxidant is fed in excess of 300% over the theoretical required for complete destruction of the emulsion's organic load. The emulsion is pumped at a rate of 2.3 mL/min and the oxidant at a rate of 10 mL/min. The high-pressure flow of the oxidant is preheated in the heater (G) at 350° C. and in the pre-heater (H), which are submerged in an isothermal bath surrounded by electrical resistances of 350° C. to 530° C. that control the reaction temperature, while the high-pressure flow of the emulsion of PCBs flows through the pre-heater ($H_1$) where it is heated from 25° C. to 530° C. The arrangement of the isothermal bath could be easily substituted by a furnace or simply by clamp-type resistance heaters, as long as they supply the rapid heating required in the process. The high-pressure flows and temperature are mixed in a T in the reactor input (J). The residence time in the reactor at 530° C. and 240 atmospheres is 30 seconds. The reactor effluent is cooled in the concentric tube heat exchanger (O) to 25° C. The system pressure and the output flow volume are regulated by the needle valve (T). The phase separation and collection of samples for analysis is carried out in tanks (R) and (S).

Analyses conducted on samples collected under these experimental conditions show that there is 99.999% destruction of organic matter represented as total organic carbon. The analysis of PCBs in aqueous samples was conducted via gas chromatography with electron capture detector.

Prior to conducting the analysis of the liquid simple, dichloromethane is extracted to concentrate the PCBs and facilitate their identification, according to procedures standardized for analysis of these types of samples. Under these conditions, a concentration of PCBs at 1.4 micrograms per liter is obtained in the effluent, a value satisfying the strictest PCB-emission standards. The efficiency of PCB destruction is at 99.999%. The efficiency of the destruction recommended for dielectric oils contaminated with PCBs is at least 99.5% according to the Japanese norm, which also bans the incineration of PCBs due to the high potential for generating dioxins and furans, substances that have been catalogued as highly toxic (Weber, R., Takasuga, T., Nagai, K., Shiraishi, H., Sakurai, T., Matuda, T. and Hiraoka, M., 2002. Dechlorination and destruction of PCDD, PCDF and PCB on selected fly ash from municipal waste incineration. Chemosphere 46, pp. 1255-1262).

EXAMPLE 2

In a second non-limiting example of the invention, a simulated residue of pyridine in a concentration of 0.124 mol/L of total organic carbon is treated. The mixture of contaminants to be treated is fed onto the tank (C) and the peroxide at 8% in weight is fed onto tanks (A) and (B). The tanks are pressurized through nitrogen at 50 psi available from the reservoir (D). Residues of pyridine and oxidant are pressurized by high-pressure pumps (E) and (F) at 240 atmospheres. The oxidant is fed in excess of 250% over the theoretical required for the complete destruction of the pyridine organic load. The aqueous residue of pyridine is pumped at a rate of 4.6 mL/min and the oxidant at a rate of 10 mL/min. The high-pressure flow of the oxidant is pre-heated in the heater (G) at 350° C. and in the pre-heater (H), which are submerged in an isothermal bath surrounded by electrical resistances of 350° C. up to the reaction temperature, while the high-pressure flow of the aqueous pyridine residue flows through the pre-heater ($H_1$) where it is heated from 25° C. to reaction temperature. As indicated in the previous example, the arrangement of the isothermal bath could be easily substituted by a furnace or simply by clamp-type resistance heaters, as long as they supply the rapid heating required in the process. The high-pressure flows and temperature are mixed in a T in the reactor input (J). The residence time in the reactor at 530° C. and 240 atmospheres is 30 seconds. The reactor effluent is cooled in the concentric tube heat exchanger (O) to 25° C. The system pressure and the output flow volume are regulated by the needle valve (T). The phase separation and collection of samples for analysis is carried out in tanks (R) and (S)

Upon conducting the process of chemical transformation, samples were taken at reaction temperatures of 500, 530, and 550° C. obtaining total conversions of the organic matter in terms of total organic carbon destruction of 99.2%, 99.5%, and 99.9%, respectively. Thus, when carrying out the chemical analysis on the effluent, it was possible to establish that it fulfills the emission standards for pyridine according to Decree 4741 of 2005 from the Ministry of the Environment, Housing, and Territorial Development of the Republic of Colombia.

Although the current invention has been described through the preferred embodiments revealed as non-limiting of the invention, it is taken that the modifications and variations that preserve its essential and elemental contents are understood within the scope of the claims included.

The invention claimed is:

1. A process for destruction of toxic wastes through oxidation in the presence of water which comprises the following stages:

(a) mix a toxic waste contaminated oily liquid with water at ambient temperature and a non-ionic emulsifying agent with Hydrophilic-lipophilic balance (HLB) between 10 and 20 and agitate the mixture to form an emulsion, wherein the water is present at 40% by weight;

(b) bring the emulsion from stage a) to a pressure between 22,291 and 40,530 kPa and to a temperature between 643 and 853K;

(c) bring an oxidant selected from the group consisting of aqueous hydrogen peroxide, potassium permanganate, potassium dichromate, manganese dioxide and combinations thereof to a pressure between 22,291 and 40,530 kPa;

(d) heat in a first stage the oxidant from stage c) up to a temperature between 573 and 643 K and in a second stage up to a temperature between 644 and 853 K;

(e) mix in a reaction unit the emulsion from stage a) and the oxidant from stage d) at a temperature between 644 and 853 K and at pressure between 22,291 and 40,530 kPa during a period of time between 30 seconds and 5 minutes yielding an effluent (f) subject to cooling the effluent from stage e) at a temperature equal to or below 298 K; and (g) separate and store in a gas stream and a liquid stream homogeneous phases obtained in stage f).

2. A process according to claim 1 further characterized in that stage e) from the oxidation process approaches an adiabatic operation.

3. A process according to claim 1 wherein in either stage a) or in stage f) an alkaline agent selected from the group consisting of NaOH and KOH is added to neutralize acids formed during the oxidation stage of organochlorine.

4. A process according to claim 1 further characterized in that the addition of alkalizing salts is not required for pretreatment of the toxic waste contaminated oily liquid.

5. A process for the destruction of toxic wastes according to claim 1 wherein, the mixture created in stage (a) is agitated by an ultrasound probe to form an emulsion.

6. A process for the destruction of toxic wastes according to claim 5 wherein, the ultrasound probe's intensity is between 5 to 30 Kilohertz for at least one minute.

7. A process according to claim 1 further characterized in that stage (e) proceeds in the presence of a heterogeneous catalyst selected from the group consisting of $Fe_3O_4$, $MnO_2$, CuO, NiO, $Al_2O_3$, $Cu_3O_4$, and Pt.

* * * * *